US010062318B2

(12) United States Patent
Hsieh et al.

(10) Patent No.: US 10,062,318 B2
(45) Date of Patent: Aug. 28, 2018

(54) METHOD AND DRIVING SYSTEM FOR DRIVING A LIGHT-EMITTING DIODE DEVICE

(71) Applicant: MACROBLOCK, INC., Hsinchu (TW)

(72) Inventors: Jiann-Horng Hsieh, Hsinchu (TW); Chung-Hung Shih, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

(21) Appl. No.: 15/190,016

(22) Filed: Jun. 22, 2016

(65) Prior Publication Data

US 2016/0379539 A1 Dec. 29, 2016

(30) Foreign Application Priority Data

Jun. 24, 2015 (TW) ..... 104120325 A

(51) Int. Cl.
*G09G 3/32* (2016.01)
*G09G 3/20* (2006.01)

(52) U.S. Cl.
CPC ..... *G09G 3/32* (2013.01); *G09G 3/2022* (2013.01); *G09G 2310/0213* (2013.01); *G09G 2360/16* (2013.01); *G09G 2370/08* (2013.01)

(58) Field of Classification Search
None
See application file for complete search history.

(56) References Cited

U.S. PATENT DOCUMENTS

2003/0111966 A1* 6/2003 Mikami ..... G09G 3/3233 315/169.3

FOREIGN PATENT DOCUMENTS

| | | | |
|---|---|---|---|
| CN | 104217683 | A | 12/2014 |
| CN | 104485070 | A | 4/2015 |
| TW | 201112209 | A1 | 4/2011 |
| TW | 201506872 | A | 2/2015 |

* cited by examiner

*Primary Examiner* — Brian Butcher
(74) *Attorney, Agent, or Firm* — Christensen O'Connor Johnson Kindness PLLC

(57) ABSTRACT

In a method for driving a light-emitting diode (LED) device, a driving system is configured to: a) receive a number of driving signals, each corresponding to a period the LED device is to be activated; b) determine a number of repetitions for output of each of the driving signals; c) determine an average driving period for each of the driving signals; d) constructing a sequence list of driving signals to be sent to the LED device, the sequence list including a plurality of rows, each of the rows is numbered and includes two columns for containing respectively two entries of the driving signals therein; and e) sequentially transmit the two entries of the driving signals contained in each of the rows included in the sequence list to the LED device.

12 Claims, 11 Drawing Sheets

METHOD AND DRIVING SYSTEM FOR DRIVING A LIGHT-EMITTING DIODE DEVICE

CROSS-REFERENCE TO RELATED APPLICATION

This application claims priority of Taiwanese Patent Application No. 104120325, filed on Jun. 24, 2015.

FIELD

The disclosure relates to a method and a driving system for driving operations of a light-emitting diode (LED) device.

BACKGROUND

A conventional light-emitting diode (LED) device may be driven by a driving system to adjust an overall brightness thereof. The driving system is coupled to the LED device, and is configured to acquire a number of driving signals each representing a brightness bit associated with a specific level of brightness, and to sequentially transmit the driving signals to the LED device for driving the operation thereof.

FIG. 1 illustrates the driving signals being transmitted to the LED device (not shown). Firstly, a first one of the driving signals (M1) (representing a lowest brightness bit) is to be stored by the driving system and transmitted. The storing and transmitting of each driving signal requires a preparation period ($T_1$). Upon receipt of the driving signal (M1), LEDs of the LED device are each turned on or off for a predetermined driving period ($T_2$). Note that transmission of the driving signal takes up an insignificant amount of time in comparison with the storage of the same, and so in the figure, the preparation period ($T_1$) is labeled to indicate the time for storage only.

For the driving system, after the driving signal (M1) is transmitted, a second one of the driving signals (M2) (representing a second lowest brightness bit) is subsequently stored and transmitted. Such an operation similarly requires the preparation period ($T_1$). Upon receipt of the driving signal (M2), the LEDs of the LED device are each turned on or off for another driving period associated with the driving signal (M2). In this example, the driving period equals ($2*T_2$). It is noted that a longer driving period is associated with a higher brightness bit, which is associated with a higher level of brightness.

The driving system then stores and transmits each of the remaining driving signals to the LED device, and the LED device is to be driven according to the driving signals in like manner.

However, since the preparation period ($T_1$) and the various driving periods associated with the driving signals are not identical, an efficiency of the LED device may be reduced. For example, in the example as illustrated in FIG. 1, after the LED device is driven by the first one of the driving signals (M1) for the predetermined driving period ($T_2$), the next one of the driving signals (M2) is still in the process of being stored and transmitted, thus leaving the LED device in a non-driven state, in which the LED device is inactive (i.e., does not emit light).

On the other hand, a higher brightness bit corresponds to a longer driving period, and when the driving period associated with a particular driving signal is larger than the time period ($T_1$) for storing and transmitting, the LED device may not be able to receive a next one of the driving signals for quite a while, during which time the driving system is in an idle state.

Both the LED device being inactive and the driving system being in the idle state induce undesired effects, reducing the efficiency of the LED device, and with the longer the LED device is inactive, a resulting overall brightness of the LED device is reduced.

Additionally, a refresh cycle of the conventional LED device is one in which all driving signals are transmitted to the LED device with the LED device operating accordingly. As described above, the longer the idle time, the longer the refresh cycle.

SUMMARY

Therefore, an object of the disclosure is to provide a method that can alleviate at least one of the drawbacks of the prior art.

According to one embodiment of the disclosure, a method for driving a light-emitting diode (LED) device is to be implemented using a driving system that is coupled to the LED device. The method includes the steps of:

a) receiving, by the driving system, a number (M) of driving signals, each of the driving signals corresponding to a respective predetermined driving period the LED device is to be activated;

b) determining, by the driving system, a number of repetitions for output of the driving signals, respectively;

c) determining, by the driving system, an average driving period for each of the driving signals by dividing the respective one of the predetermined driving periods by a corresponding one of the numbers of repetitions;

d) constructing, by the driving system, a sequence list of driving signals to be sent to the LED device, wherein the sequence list includes a plurality of rows, each of the rows is numbered and includes two fields for containing respectively two entries of the driving signals therein, and a number of times each of the driving signals appearing in the sequence equals the corresponding one of the numbers of repetitions; and e) sequentially transmitting, by the driving system, the two entries of the driving signals contained in the rows included in the sequence list to the LED device for driving the LED device in the order of the number of the rows, with each appearance of one of the driving signals indicating that the LED device is to be activated for the average driving period determined for the driving signal in step c).

According to one embodiment of the disclosure, a method for driving a light-emitting diode (LED) device to be implemented using a driving system that is coupled to the LED device includes the steps of:

a) receiving, by the driving system, a number (M) of driving signals, each of the driving signals corresponding to a respective predetermined driving period the LED device is to be activated;

b) constructing, by the driving system, a plurality of driving lists, wherein each of the driving lists includes one of a plurality of sets of numbers of repetitions for output of the driving signals, respectively, and a corresponding one of a plurality of sets of average driving periods for the respective driving signals, the corresponding one of the sets of average driving periods being determined based on the predetermined driving periods and said one of the sets of numbers of repetitions;

c) selecting, by the driving system, one of the driving lists, and constructing a sequence list of the driving signals to be sent to the LED device based on the selected one of the driving lists, wherein the sequence list includes a plurality of rows, each of the rows is numbered and includes two fields for containing respectively two entries of the driving signals therein, and a number of times each of the driving signals appearing in the sequence list equals a corresponding one of the numbers of repetitions; and d) sequentially transmitting, by the driving system, the two entries of the driving signals contained in the rows included in the sequence list to the LED device for driving the LED device in the order of the number of rows, with each appearance of one of the driving signals indicating that the LED device is to be activated for the average driving period corresponding to the one of the driving signals.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
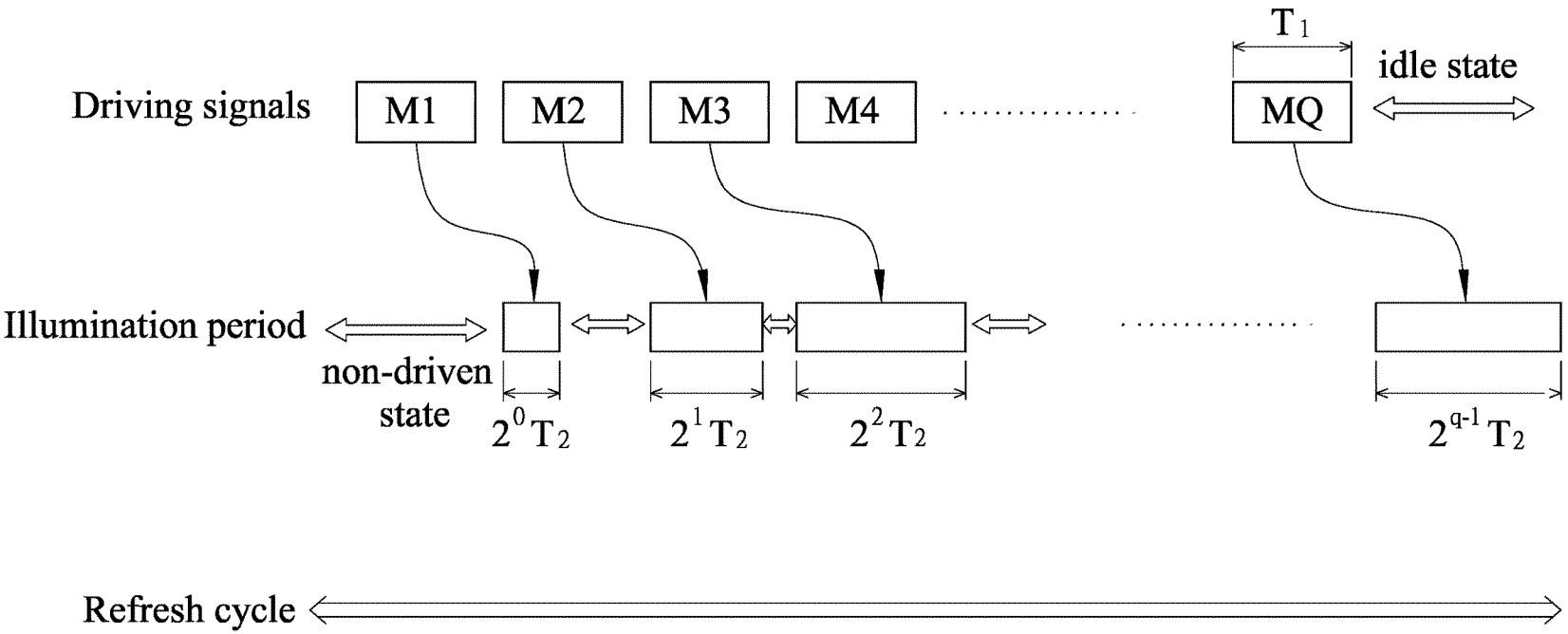
FIG. 1 illustrates a conventional method for driving a light-emitting diode (LED) device, in which driving signals are transmitted to the LED device.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
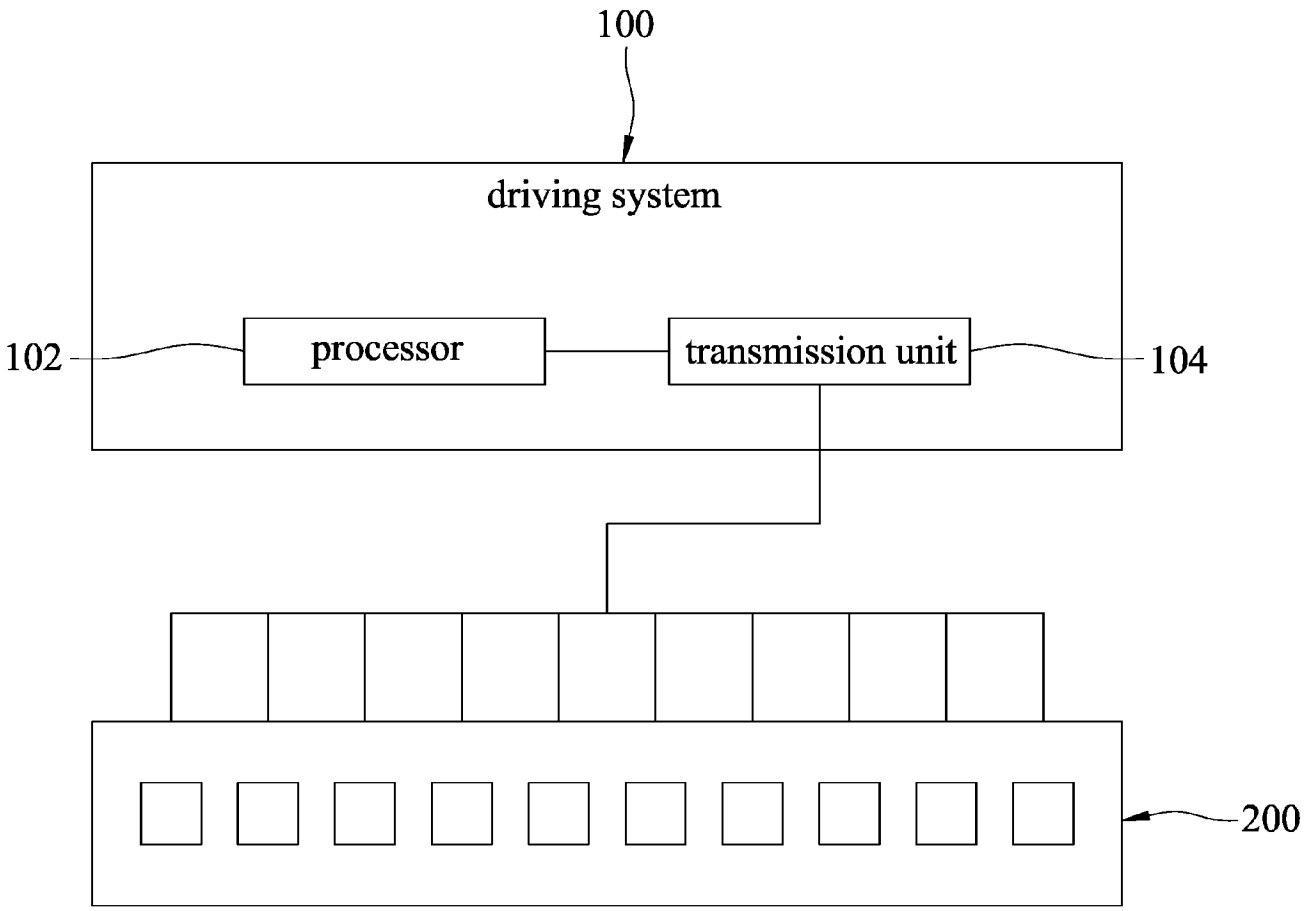
FIG. 2 is a block diagram of a driving system coupled to an LED device for driving the same, according to one embodiment of the disclosure.

FIG. 2 is a block diagram illustrating a driving system 100 for driving a light-emitting diode (LED) device 200, according to one embodiment of the disclosure. In this embodiment, the driving system 100 includes a processor 102 and a transmission unit 104. In this embodiment, the driving system 100 may be embodied using a driving integrated circuit (IC), and the LED device 200 may be embodied using an LED display screen.

The LED device 200 is coupled to the transmission unit 104 of the driving system 100, and includes an LED array that includes a plurality of LEDs 201 (ten in this embodiment).

Figure 3:
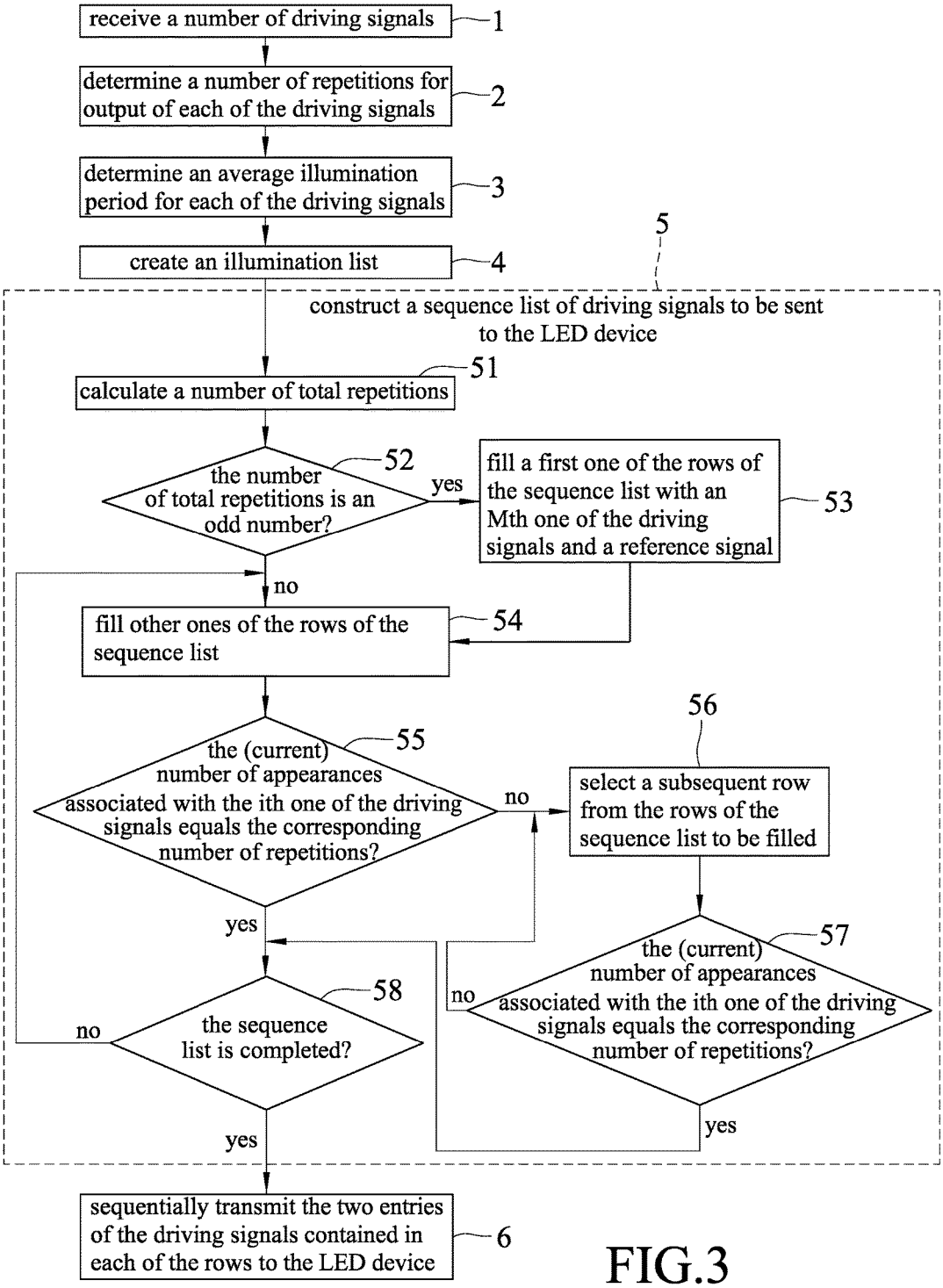
FIG. 3 is a flow chart illustrating steps of a method implemented by the driving system, according to one embodiment of the disclosure.

When it is desired to drive the operation of the LED device 200, the driving system 100 is operable to perform a method for driving the LED device 200 as shown in FIG. 3.

In step 1, the driving system 100 receives a number (M) of driving signals. Specifically, each of the driving signals corresponds to a respective predetermined driving period during which the LED device 200 is to be activated (to be driven such that the LEDs 201 of the LED device 200 are driven to each turn on or off). It is known that, for one of the driving signals to be stored by the driving system 100 for transmission to the LED device 200, a preparation period ($t_1$) is required. Note that since the time taken up by transmission of the driving signal is considered insignificant, it will be assumed throughout the specification that the preparation period ($T_1$) is substantially taken up by the storage of the driving signal.

A greater brightness may be achieved by a longer driving period for the LED device 200.

For example, the driving signals may, collectively speaking, be in the form of a binary string having (M) bits, with an $i^{th}$ one of the driving signals corresponding to an $i^{th}$ bit of the binary string, where i is a positive integer and $1 \le i \le M$. The binary string represents the overall brightness the LED device 200 is to be driven to achieve. In this embodiment, the number (M) of the driving signals is 14 (the driving signals are referred to as D1 to D14 herein), corresponding with 14 brightness bits to indicate a specific level of brightness. The brightness bits have different bit orders defined to be 1 to 14, and are also known as $1^{st}$ to $14^{th}$ brightness bits herein, with the $1^{st}$ brightness bit being the least significant bit and the $14^{th}$ brightness bit being the most significant bit (having the greatest effect on the overall brightness of the LED device 200 as compared to the rest of the brightness bits). In other embodiments, the significance of the 14 brightness bits on the overall brightness may vary.

Moreover, each of the driving signals includes a plurality of logic states each to be transmitted to a corresponding one of the LEDs 201 for switching the same between conduction and non-conduction (turning the LED on or off). In this embodiment, the number of the logic states equals to the number of the LEDs 201 included in the LED device 200 (i.e., 10).

In step 2, the driving system 100 determines a number of repetitions for output of each of the driving signals.

Specifically, the object of this step is to attempt to split the longer ones of the driving periods, which are associated with higher brightness bits, into a number of shorter periods.

In this embodiment, the driving system 100 is configured to create a set of the numbers of repetitions respectively associated with the driving signals using the following two rules: a. the number of repetitions for output of the driving signal (D1) is 1; and b. a number of repetitions for output of a particular one of the driving signals ($D_{n+1}$) is either equal to the number of repetitions for output of a previous one of the driving signals ($D_n$) or twice the number of repetitions for output of the previous one of the driving signals ($D_n$), $1 \le n < M$.

In step 3, the driving system 100 determines an average driving period for each of the driving signals based on the respective predetermined driving period and a corresponding one of the numbers of repetitions. The average driving period defines how long the corresponding driving signal is to be outputted in each repetition.

Specifically, the driving system 100 obtains the average driving period for each of the driving signals by dividing the respective predetermined driving period by the corresponding one of the numbers of repetitions.

In this embodiment, for an $i^{th}$ one of the driving signals, the respective predetermined driving period equals $2^{(i-1)}*t_2$, where $t_2$ represents a unit driving period.

In step 4, the driving system 100 creates a driving list that includes the set of the numbers of repetitions for output of the driving signals, respectively, and a set of the average driving periods for the driving signals, respectively. The following Table 1 shows an exemplary driving list.

TABLE 1

| Driving Signal | Number of Repetitions | Average Driving Period | Predetermined Driving Period |
|---|---|---|---|
| D1 | 1 | $\frac{2^0t_2}{1} = t_2$ | $2^{1-1}t_2 = 2^0t_2$ |
| D2 | 2 | $\frac{2^1t_2}{2} = t_2$ | $2^{2-1}t_2 = 2^1t_2$ |
| D3 | 4 | $\frac{2^2t_2}{4} = t_2$ | $2^{3-1}t_2 = 2^2t_2$ |
| D4 | 8 | $\frac{2^3t_2}{8} = t_2$ | $2^{4-1}t_2 = 2^3t_2$ |
| D5 | 16 | $\frac{2^4t_2}{16} = t_2$ | $2^{5-1}t_2 = 2^4t_2$ |
| D6 | 16 | $\frac{2^5t_2}{16} = 2t_2$ | $2^{6-1}t_2 = 2^5t_2$ |
| D7 | 16 | $\frac{2^6t_2}{16} = 4t_2$ | $2^{7-1}t_2 = 2^6t_2$ |
| D8 | 32 | $\frac{2^7t_2}{32} = 4t_2$ | $2^{8-1}t_2 = 2^7t_2$ |
| D9 | 32 | $\frac{2^8t_2}{32} = 8t_2$ | $2^{9-1}t_2 = 2^8t_2$ |
| D10 | 32 | $\frac{2^9t_2}{32} = 16t_2$ | $2^{10-1}t_2 = 2^9t_2$ |
| D11 | 32 | $\frac{2^{10}t_2}{32} = 32t_2$ | $2^{11-1}t_2 = 2^{10}t_2$ |
| D12 | 32 | $\frac{2^{11}t_2}{32} = 64t_2$ | $2^{12-1}t_2 = 2^{11}t_2$ |
| D13 | 32 | $\frac{2^{12}t_2}{32} = 128t_2$ | $2^{13-1}t_2 = 2^{12}t_2$ |
| D14 | 64 | $\frac{2^{13}t_2}{64} = 128t_2$ | $2^{14-1}t_2 = 2^{13}t_2$ |

Based on the above table, the average driving period of the driving signal (D6) may be calculated by dividing the respective predetermined driving period ($2^5t_2=32t_2$) by the corresponding number of repetitions (16). As such, the driving signal (D6) may be represented by 16 segments of outputs, each having the average driving period of $2t_2$. Similarly, the driving signal (D14) may be represented by 64 segments of outputs, each having the average driving period of $128t_2$.

In step 5, the driving system 100 constructs a sequence list of driving signals to be sent to the LED device 200. Specifically, the sequence list includes a number (N) of rows, where (N) is a positive integer, and where each of the rows is numbered (row 1, row 2, row 3, etc.) and includes two fields for containing respectively two entries of the driving signals therein. In other words, the sequence list has (N) number of rows and two columns.

Additionally, for each of the rows, one of the driving signals contained in a first one of the two fields is associated with a brightness bit that is lower than that of one of the driving signals contained in a second one of the two fields. A number of times each of the driving signals appearing in the sequence list equals the corresponding number of repetitions.

The construction of the sequence list may be further described by the following sub-steps.

In sub-step 51, the driving system 100 calculates a number of total repetitions by adding the numbers of repetitions for the respective driving signals (D1 to D14). Referring to Table 1, in this embodiment, the number of total repetitions equals to 319.

In sub-step 52, the driving system 100 determines whether the number of total repetitions is an odd number. When it is determined that the number of total repetitions is an odd number, the flow proceeds to sub-step 53. Otherwise, the flow proceeds to sub-step 54.

In sub-step 53, the driving system 100 fills a first one of the rows of the sequence list with an $M^{th}$ one of the driving signals and a reference signal ($R_s$). In this embodiment, the reference signal switches the LED device 200 to a non-illumination state (i.e., all of the LEDs 201 are turned off), and the driving signal (D14) and the reference signal are filled in the first row of the sequence list.

The flow proceeds to sub-step 54 after sub-step 53. In sub-step 54, the driving system 100 fills an $i^{th}$ one of the driving signals for the first time in the sequence list, where i is a positive integer and $1 \leq i < M$.

Figure 4:
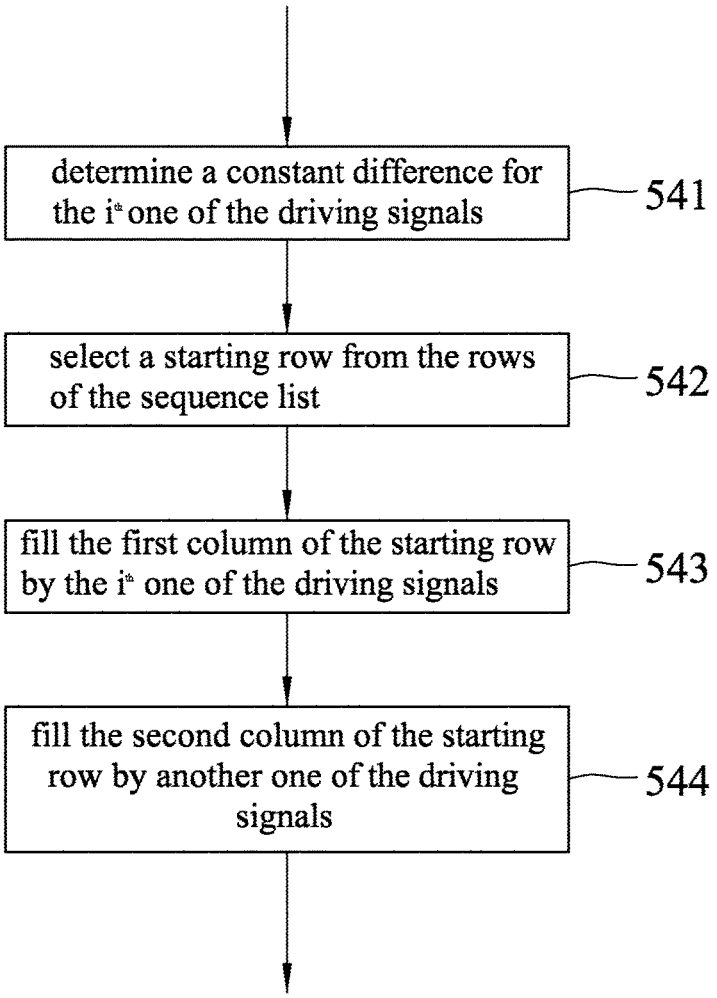
FIG. 4 is a flow chart illustrating steps for filling a sequence list with a plurality of driving signals, according to one embodiment of the disclosure.

Referring to FIG. 4, the operations of sub-step 54 may be further described by the following sub-steps.

In sub-step 541, for the $i^{th}$ one of the driving signals, the driving system 100 determines a constant difference which indicates a distance measured in a number of rows between a prior row and a subsequent row for the $i^{th}$ one of the driving signals.

The constant difference for the $i^{th}$ one of the driving signals is obtained by dividing a total occurrence number by the corresponding number of repetitions of the $i^{th}$ one of the driving signals. Specifically, the total occurrence number is obtained by dividing the number of total repetitions by 2. It is noted that, the number (N) of rows of the sequence list equals the total occurrence number thus calculated.

For example, in this case, the number of total repetitions is 319, and the total occurrence number is 160 (rounding up 159.5 to obtain a greater integer). As a result, the sequence list includes 160 rows for containing the 319 repetitions of the driving signals and the reference signal. Moreover, for the driving signal (D2), the number of repetition equals to 2, and therefore the constant difference equals 80.

In sub-step 542, for the $i^{th}$ one of the driving signals, the driving system 100 selects a starting row from the rows of the sequence list at which the $i^{th}$ one of the driving signals is to appear for the first time.

In one embodiment, the driving system 100 randomly selects one of the rows that does not contain any of the driving signal as the starting row for the $i^{th}$ one of the driving signals.

In another embodiment, the driving system 100 selects the starting row for the $i^{th}$ one of the driving signals by identifying a largest number of successive rows in the sequence list in which none of the rows is filled, determining a middle one of the rows in the largest number of successive rows, and selecting one of the rows subsequent to the middle one of the rows as the starting row.

For example, for the driving signal (D1), since none of the 160 rows contains any driving signal (note that in this example, the flow proceeds from step 52 directly to step 54), the driving system 100 determines a middle one of the rows (160/2=80) in the largest number of successive rows, and then selects the row 81 as the starting row.

As another example, for the driving signal (D2), since none of rows 1 to 80 contains any driving signal, the same are identified as the largest number of successive rows, and the driving system 100 determines a middle one of the rows (80/2=40) in thereamong, and then selects the row 41 as the starting row.

In sub-step 543, for the $i^{th}$ one of the driving signals, the driving system 100 fills the first field of the corresponding starting row with the $i^{th}$ one of the driving signals.

In sub-step 544, the driving system 100 fills the second field of the starting row for the $i^{th}$ one of the driving signals with another one of the driving signals.

Specifically, the another one of the driving signals corresponding with a largest brightness bit of the binary string whose (current) number of appearances in the sequence list is smaller than (i.e., is not equal to) the corresponding number of repetitions. For example, the second field of each of the rows 81 and 41 may be filled with D14, which is to appear in the sequence list up to 64 times.

Referring back to FIG. 3, in sub-step 55, the driving system 100 determines whether the (current) number of appearances associated with the $i^{th}$ one of the driving signals in the sequence list equals the corresponding number of repetitions. When the determination is affirmative, the flow proceeds to sub-step 58. Otherwise, the flow proceeds to sub-step 56.

In sub-step 56, for the $i^{th}$ one of the driving signals, the driving system 100 selects a subsequent row from the rows of the sequence list at which the $i^{th}$ one of the driving signals is to appear again, and fills the subsequent row of the sequence list.

Figure 5:
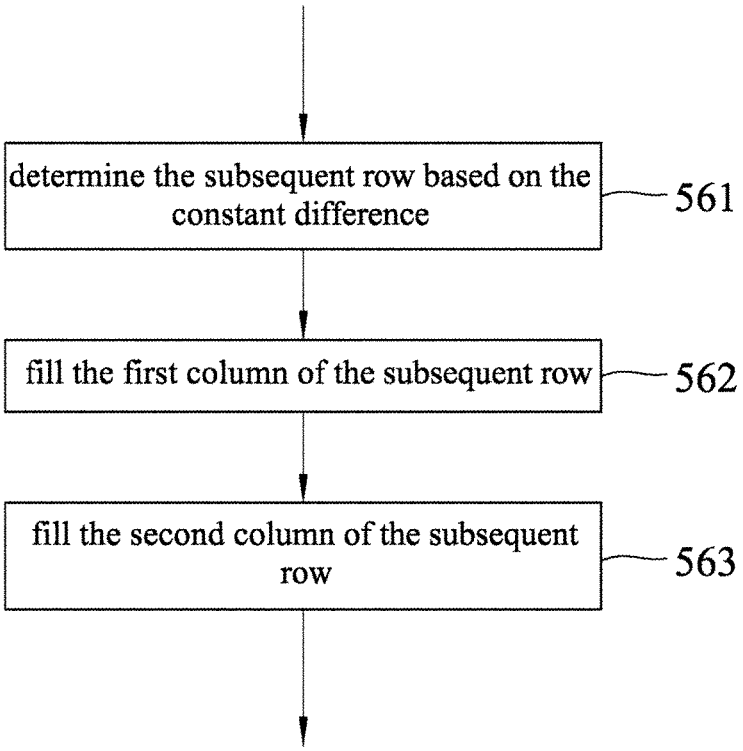
FIG. 5 is a flow chart illustrating steps for distributing the driving signals into the sequence list, according to one embodiment of the disclosure.

Referring to FIG. 5, the operations of sub-step 56 may be further described by the following sub-steps.

In sub-step 561, the driving system 100 determines the subsequent row for the $i^{th}$ one of the driving signals based on the corresponding starting row and the constant difference associated with the $i^{th}$ one of the driving signals.

For example, after the driving signal (D2) is first filled in the row 41, in sub-step 55 it is determined that the current number of appearances (1) is smaller than the number of repetitions (2). Then, in sub-step 561, the subsequent row is determined based on the constant difference (160/2=80). Specifically, the driving system 100 adds the constant difference (80) to the number of the starting row (41), and selects the row 121 as the subsequent row. In this manner, it may be ensured that each driving signal will be uniformly distributed among the rows of the sequence list to prevent undesired effects such as unwanted shadow in an image captured in a camera due to an unbalanced grayscale.

In sub-step 562, the driving system 100 fills the first field of the subsequent row for the $i^{th}$ one of the driving signals with the $i^{th}$ one of the driving signals. For example, the driving system 100 fills the first field of the row 121 with the driving signal (D2).

In sub-step 563, the driving system 100 fills the second field of the subsequent row for the $i^{th}$ one of the driving signals with another driving signal. For example, the driving system 100 fills the second field of the row 121 with the driving signal (D14). It is noted that the manner in which the another driving signal is selected to be filled in the second field of the subsequent row for the $i^{th}$ one of the driving signals may be the same as that of sub-step 544 as described above.

In sub-step 57, the driving system 100 repeats the determination done in sub-step 55. When the determination is affirmative, the flow goes back to sub-step 58. Otherwise, the flow proceeds to sub-step 56.

In sub-step 58, the driving system 100 determines whether the sequence list is completed, i.e., whether all rows included in the sequence list are filled. When the determination is negative (i.e., the sequence list is not completed yet), the flow goes back to sub-step 54, increments the number of i by 1 and increments the number of j by 1. Otherwise, the flow proceeds to step 6.

The following Table 2 shows first ten rows of an exemplary sequence list created by the above steps.

TABLE 2

| First Column | Second Column |
|---|---|
| The Reference Signal | D14 |
| D9 | D12 |
| D8 | D13 |
| D6 | D14 |
| D10 | D11 |
| D5 | D14 |
| D9 | D12 |
| D8 | D13 |
| D7 | D14 |
| D10 | D11 |

In step 6, the driving system 100 sequentially transmits the two entries of the driving signals contained in the rows included in the sequence list to the LED device 200 for driving the LED device 200 in the order of the number of the rows, with each appearance of one of the driving signals indicating that the LED device 200 is to be activated for the corresponding average driving period. It is noted that, in this embodiment, the driving signal contained in the second column will first be stored and transmitted to the LED device 200.

Figure 6:
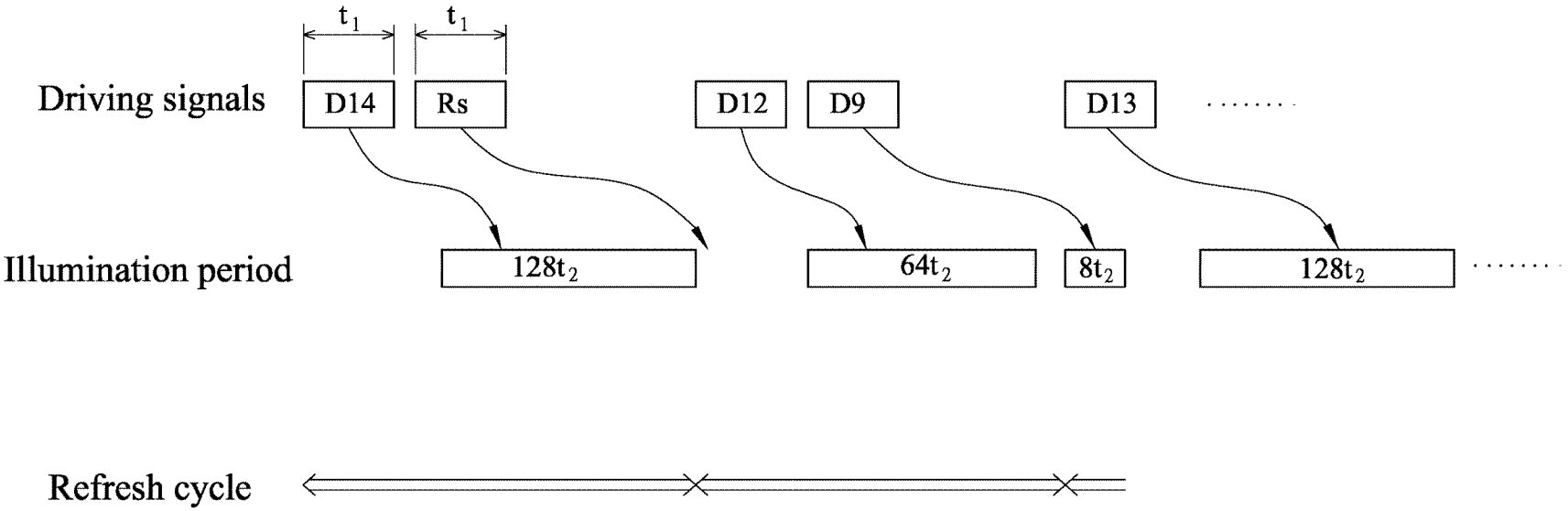
FIG. 6 illustrates the driving signals contained in the sequence list being sequentially transmitted to the LED device.

For example, referring to FIG. 6, the driving signal (D14) and the reference signal ($R_s$) contained in row 1 of the sequence list are the first ones of the driving signals to be transmitted to the LED device 200. The driving system 100 first stores the driving signal (D14), taking up the preparation period ($t_1$) before the driving signal (D14) is received by the LED device 200.

In response to the driving signal (D14), the LED device 200 is activated for the average driving period ($128t_2$) after the preparation period ($t_1$). In the mean time, the driving system 100 stores the reference signal ($R_s$), also substantially taking up the preparation period ($t_1$).

After the average driving period ($128t_2$) for the driving signal (D14) is over, the LED device 200 receives the reference signal ($R_s$) from the driving system 100, and is deactivated for a period specified by the reference signal ($R_s$).

It is noted that the LED device 200 may be configured such that each time the two entries in a row of the sequence list have been received by the LED device 200 for corresponding operation thereof, the LED device 200 performs a refresh operation. That is to say, the average driving period ($128t_2$) for the driving signal (D14) and the period specified by the reference signal ($R_s$) constitute a refresh cycle for the LED device 200.

After the period specified by the reference signal ($R_s$) has elapsed, the driving signals (D12) and (D9) contained in row 2 of the sequence list are next to be transmitted to the LED device 200.

Specifically, right after the reference signal ($R_s$) is transmitted to the LED device 200, the driving system 100 stores the driving signal (D12) which is contained in the second column of row 2. After the preparation period ($t_1$), the driving signal (D12) is available for transmission.

In response to the driving signal (D12), the LED device 200 is activated for the corresponding average driving period ($64t_2$). Afterward, in response to the driving signal (D9), the LED device 200 is activated for the corresponding average driving period ($8t_2$).

The driving signals listed in other rows of the sequence list are then transmitted to the LED device 200 for driving the same in a similar manner.

In one embodiment, the unit driving period ($t_2$) may be calculated using an optimization algorithm in order to allow the LED device 200 to remain active for as long as possible, given that a number of occurrences of refresh operation is fixed, thereby enhancing utilization of the LED device 200.

Figure 7:
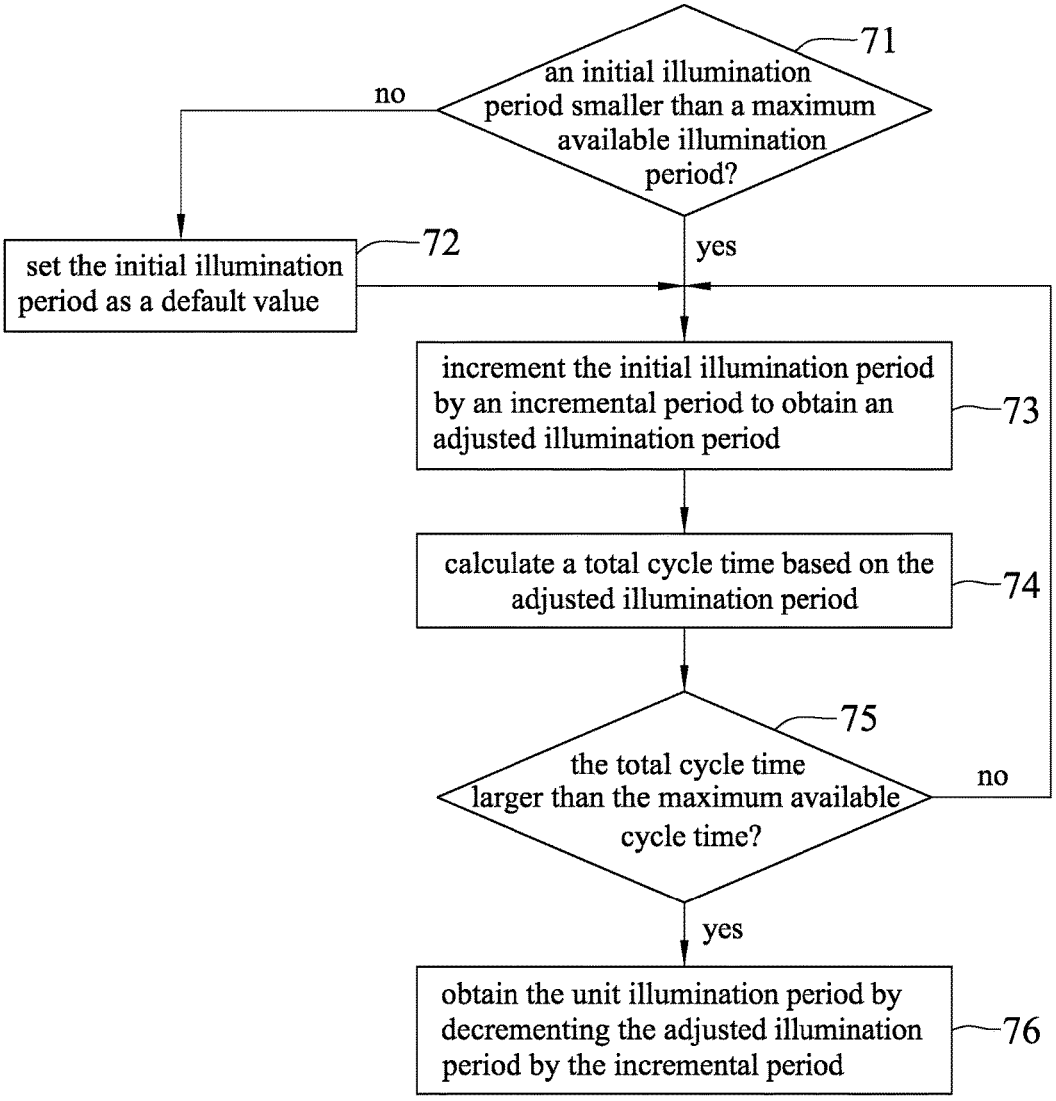
FIG. 7 is a flow chart illustrating steps of an optimization algorithm for determining a unit driving period.

Referring to FIG. 7, the optimization algorithm is implemented by the driving system 100 and includes the following steps.

In step 71, the driving system 100 compares an initial driving period with a maximum available driving period. Specifically, the maximum available driving period is associated with an upper bound of the unit driving period that can be supported by the driving system 100.

When such a determination is affirmative, the flow proceeds to step 73. Otherwise, the flow proceeds to step 72.

In step 72, the driving system 100 sets the initial driving period as a default value. In this embodiment, the default value is a minimum operation time during which the driving system 100 is able to execute a signal (e.g., 35 nanoseconds). Afterward, the flow proceeds to step 73.

In step 73, the driving system 100 adjusts the initial driving period by adding an incremental period to the initial driving period, so as to obtain an adjusted driving period. The incremental period may for example be 5 to 10 nanoseconds.

In step 74, the driving system 100 calculates a total cycle time based on the adjusted driving period. Specifically, the total cycle time indicates length of a time period during which the LDE device 200 is to be driven by all the driving signals (D1 to D14) in the entire sequence.

Specifically, the calculation of the total cycle time is done by multiplying a cumulative value with the adjusted driving period, the cumulative value being associated with a sum of products of the numbers of repetitions and coefficients of the average driving periods, respectively.

In step 75, the driving system 100 compares the total cycle time with a maximum available cycle time (e.g., 16.67 milliseconds). When it is determined that the total cycle time is larger than the maximum available cycle time, the flow proceeds to step 76. Otherwise, the flow proceeds back to step 73, in which the driving system 100 adjusts the initial driving period by adding the incremental period again.

In step 76, the driving system 100 obtains the unit driving period ($t_2$) by subtracting the adjusted driving period by the incremental period.

Figure 8:
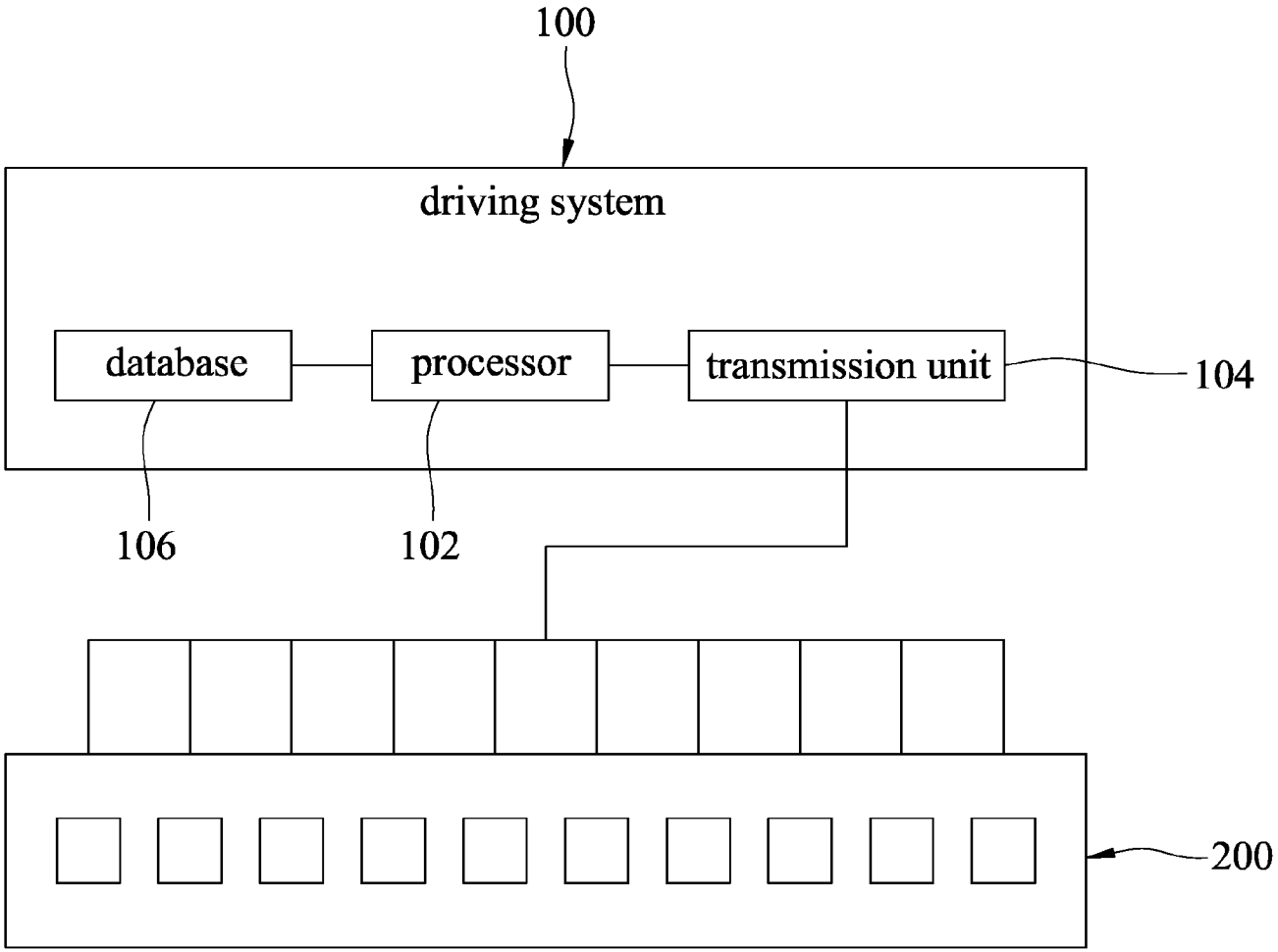
FIG. 8 is a block diagram illustrating a driving system, according to one embodiment of the disclosure.

FIG. 8 illustrates a driving system 100, according to one embodiment of the disclosure. In this embodiment, the driving system 100 further includes a database 106 coupled to the processor 102.

Figure 9:
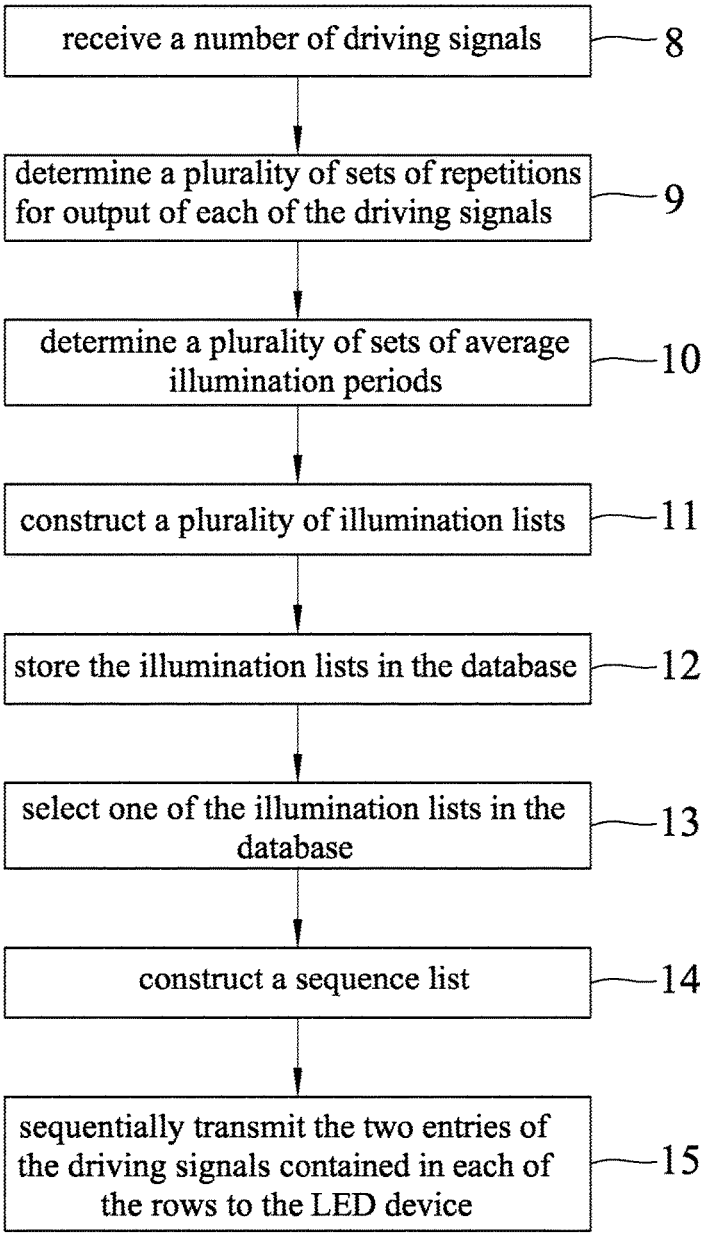
FIG. 9 is a flow chart illustrating steps of a method for driving the LED device, according to one embodiment of the disclosure.

FIG. 9 is a block diagram illustrating steps of a method for driving the LED device 200 (see FIG. 8), to be implemented by the driving system 100 as shown in FIG. 8.

In step 8, the driving system 100 receives a number (M) of driving signals. In this embodiment, the number (M) equals to 14.

In step 9, the driving system 100 determines a plurality of sets of numbers of repetitions for output of the driving signals. In this embodiment, two such sets are determined by the driving system 100, as listed in the following Table 3.

TABLE 3

| Driving Signals | Set 1 Numbers of Repetitions | Set 2 Numbers of Repetitions |
|---|---|---|
| D1 | 1 | 1 |
| D2 | 2 | 2 |
| D1 | 4 | 4 |
| D4 | 8 | 4 |
| D5 | 16 | 4 |
| D6 | 16 | 8 |
| D7 | 16 | 8 |
| D8 | 32 | 16 |
| D9 | 32 | 16 |
| D10 | 32 | 16 |
| D11 | 32 | 16 |
| D12 | 32 | 16 |
| D13 | 32 | 16 |
| D14 | 64 | 32 |

In step 10, the driving system 100 determines a plurality of sets of average driving periods. Each set of the average driving periods is determined based on the predetermined driving periods and a corresponding one of the sets of the numbers of repetitions. Each set includes the number (M) of average driving periods for the respective driving signals. In this embodiment, two such sets are determined.

In step 11, the driving system 100 constructs a plurality of driving lists. Each of the driving lists includes one of the sets of the numbers of repetitions for output of the driving signals, respectively, and a corresponding one of the sets of the average driving periods for the driving signals, respectively.

In this embodiment, two such driving lists are constructed, as listed in the following Tables 4 and 5.

| Driving Signals | Predetermined Driving Period | Number of Repetitions | Average Driving Period |
|---|---|---|---|
| D1 | $2^{1-1}t_2 = 2^0t_2$ | 1 | $\frac{2^0t_2}{1}$ |
| D2 | $2^{2-1}t_2 = 2^1t_2$ | 2 | $\frac{2^1t_2}{2}$ |

-continued

| Driving Signals | Predetermined Driving Period | Number of Repetitions | Average Driving Period |
|---|---|---|---|
| D3 | $2^{3-1}t_2 = 2^2t_2$ | 4 | $\frac{2^2t_2}{4}$ |
| D4 | $2^{4-1}t_2 = 2^3t_2$ | 8 | $\frac{2^3t_2}{8}$ |
| D5 | $2^{5-1}t_2 = 2^4t_2$ | 16 | $\frac{2^4t_2}{16}$ |
| D6 | $2^{6-1}t_2 = 2^5t_2$ | 16 | $\frac{2^5t_2}{16}$ |
| D7 | $2^{7-1}t_2 = 2^6t_2$ | 16 | $\frac{2^6t_2}{16}$ |
| D8 | $2^{8-1}t_2 = 2^7t_2$ | 32 | $\frac{2^7t_2}{32}$ |
| D9 | $2^{9-1}t_2 = 2^8t_2$ | 32 | $\frac{2^8t_2}{32}$ |
| D10 | $2^{10-1}t_2 = 2^9t_2$ | 32 | $\frac{2^9t_2}{32}$ |
| D11 | $2^{11-1}t_2 = 2^{10}t_2$ | 32 | $\frac{2^{10}t_2}{32}$ |
| D12 | $2^{12-1}t_2 = 2^{11}t_2$ | 32 | $\frac{2^{11}t_2}{32}$ |
| D13 | $2^{13-1}t_2 = 2^{12}t_2$ | 32 | $\frac{2^{12}t_2}{32}$ |
| D14 | $2^{14-1}t_2 = 2^{13}t_2$ | 64 | $\frac{2^{13}t_2}{64}$ |

TABLE 5

| Driving Signals | Predetermined Driving Period | Number of Repetitions | Average Driving Period |
|---|---|---|---|
| D1 | $2^{1-1}t_2 = 2^0t_2$ | 1 | $\frac{2^0t_2}{1}$ |
| D2 | $2^{2-1}t_2 = 2^1t_2$ | 2 | $\frac{2^1t_2}{2}$ |
| D3 | $2^{3-1}t_2 = 2^2t_2$ | 4 | $\frac{2^2t_2}{4}$ |
| D4 | $2^{4-1}t_2 = 2^3t_2$ | 4 | $\frac{2^3t_2}{4}$ |
| D5 | $2^{5-1}t_2 = 2^4t_2$ | 4 | $\frac{2^4t_2}{4}$ |
| D6 | $2^{6-1}t_2 = 2^5t_2$ | 8 | $\frac{2^5t_2}{8}$ |

TABLE 5-continued

| Driving Signals | Predetermined Driving Period | Number of Repetitions | Average Driving Period |
|---|---|---|---|
| D7 | $2^{7-1}t_2 = 2^6t_2$ | 8 | $\frac{2^6t_2}{8}$ |
| D8 | $2^{8-1}t_2 = 2^7t_2$ | 16 | $\frac{2^7t_2}{16}$ |
| D9 | $2^{9-1}t_2 = 2^8t_2$ | 16 | $\frac{2^8t_2}{16}$ |
| D10 | $2^{10-1}t_2 = 2^9t_2$ | 16 | $\frac{2^9t_2}{16}$ |
| D11 | $2^{11-1}t_2 = 2^{10}t_2$ | 16 | $\frac{2^{10}t_2}{16}$ |
| D12 | $2^{12-1}t_2 = 2^{11}t_2$ | 16 | $\frac{2^{11}t_2}{16}$ |
| D13 | $2^{13-1}t_2 = 2^{12}t_2$ | 16 | $\frac{2^{12}t_2}{16}$ |
| D14 | $2^{14-1}t_2 = 2^{13}t_2$ | 32 | $\frac{2^{13}t_2}{32}$ |

In step 12, the driving system 100 stores the driving lists in the database 106 (see FIG. 8).

In step 13, the driving system 100 selects one of the driving lists in the database 106 for subsequent use. In this embodiment, the driving list shown in Table 4 may be selected.

In step 14, the driving system 100 constructs a sequence list of driving signals to be sent to the LED device 200, based on the selected one of the driving lists.

Specifically, the sequence list includes a number (M) of rows, each of the rows is numbered and includes two fields for containing respectively two entries of the driving signals therein, and a number of times each of the driving signals appearing in the sequence list equals the corresponding number of repetitions. The construction of the sequence list is similar to that as illustrated in FIGS. 3 to 5, and details thereof are omitted herein for the sake of brevity.

In step 15, the driving system 100 sequentially transmits the two entries of the driving signals contained in the rows included in the sequence list to the LED device 200 for driving the same in the order of the number of rows. Each appearance of one of the driving signals indicates that the LED device 200 is to be activated for the corresponding average driving period.

Figure 10:
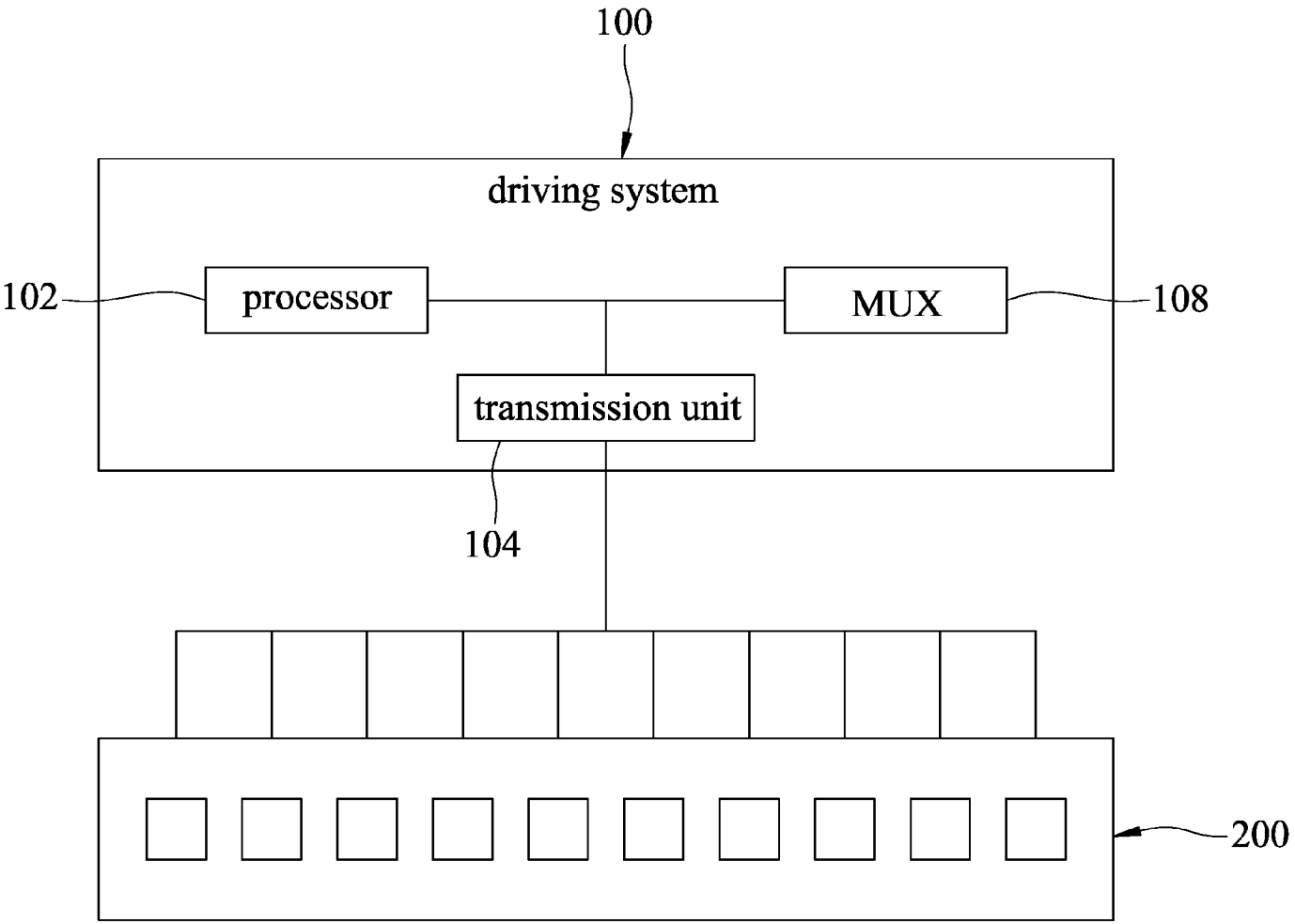
FIG. 10 is a block diagram illustrating a driving system, according to one embodiment of the disclosure.

FIG. 10 is a block diagram illustrating a driving system 100, according to one embodiment of the disclosure.

In this embodiment, the driving system 100 further includes a multiplexer (MUX) 108 coupled to the processor 102 and the transmission unit 104.

Figure 11:
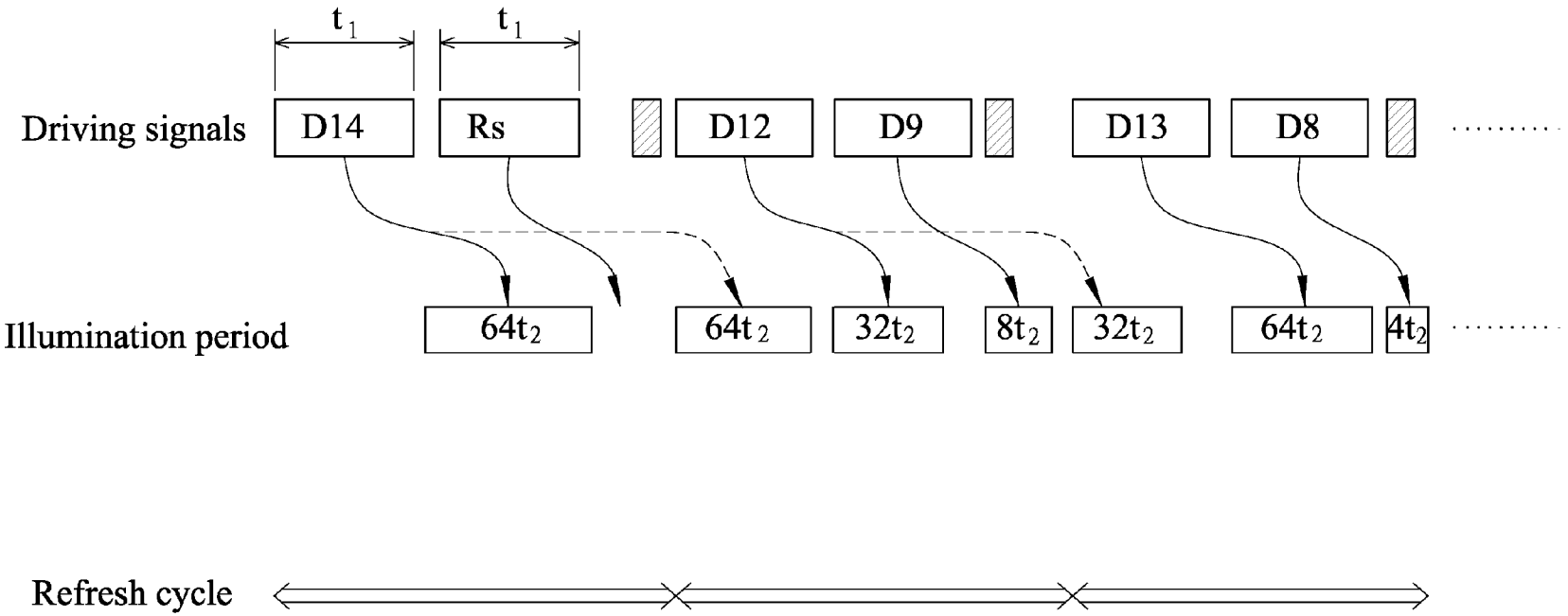
FIG. 11 illustrates the driving signals contained in the sequence list being sequentially transmitted to the LED device.

FIG. 11 illustrates the operation of transmitting the driving signals to the LED device 200 (see FIG. 10). Specifically, the sequence list used in this embodiment is one partially shown in Table 2.

For row 1, after the driving signal (D14) is transmitted to the LED device 200, the driving system 100 starts storing the reference signal ($R_s$). After the LED device 200 is activated by the driving signal D14 for a portion of the associated average driving period, the MUX 108 switches to selecting the driving signal contained in the other field of row 1 (the reference signal ($R_s$)).

Afterward, the driving system 100 transmits the reference signal ($R_s$) to the LED device 200, and the LED device 200 becomes deactivated for a period specified by the reference signal ($R_s$). After this, the MUX 108 switches back to selecting the driving signal (D14) for activating the LED device 200 for a remaining portion of the associated average driving period.

In this embodiment, the portion of the associated average driving period may be set at 50% of the associated average driving period. For example, as shown in FIG. 11, after the LED device 200 is active for half of the average driving period ($64t_2$), the MUX 108 switches to transmitting the reference signal ($R_s$) to the LED device 200. After the period specified by the reference signal ($R_s$) is over, the MUX 108 switches back to transmitting the driving signal (D14), and the LED device 200 is activated for the remaining portion of the associated average driving period ($64t_2$). In the mean time, the driving system 100 starts storing the driving signal (D12), which is contained in the second field of row 2.

One effect of the inclusion of the MUX 108 is that by dividing some of the longer average driving periods, a refresh cycle of the LED device 200 may be further reduced.

To sum up, embodiments of the disclosure provide a method for reducing the times in which the LED device 200 is not driving by any one of the driving signals, and times in which the driving system 100 waits to transmit the driving signals to the LED device 200. Moreover, the refresh operation may be implemented with a considerably higher frequency, thereby reducing the associated refresh cycle.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A method for driving a light-emitting diode (LED) device, the method to be implemented using a driving system that is coupled to the LED device, the method comprising the steps of:

a) receiving, by the driving system, a number (M) of driving signals, each of the driving signals corresponding to a respective predetermined driving period the LED device is to be activated;

b) determining, by the driving system, a set of numbers of repetitions for output of the driving signals, respectively;

c) determining, by the driving system, an average driving period for each of the driving signals by dividing the respective one of the predetermined driving periods by a corresponding one of the numbers of repetitions;

d) constructing, by the driving system, a sequence list of driving signals to be sent to the LED device, wherein the sequence list includes a plurality of rows, each of the rows is numbered and includes two fields for containing respectively two entries of the driving signals therein, and a number of times each of the driving signals appearing in the sequence equals the corresponding one of the numbers of repetitions;

e) sequentially transmitting, by the driving system, the two entries of the driving signals contained in the rows included in the sequence list to the LED device for driving the LED device in the order of the number of the rows, with each appearance of one of the driving signals indicating that the LED device is to be activated for the average driving period determined for the driving signal in step c); and f) reducing a refresh cycle of the LED device.

2. The method of claim 1, wherein:

the driving signals are in the form of a binary string having (M) number of bits, with an ith one of the driving signals corresponding with an ith bit of the binary string, where (i) is a positive integer and $1 \leq i \leq M$; and step c) includes the following sub-steps of c1) calculating, by the driving system, a number of total repetitions by adding the numbers of repetitions for the respective driving signals, c2) when it is determined that the number of total repetitions is an odd number, filling, by the driving system, the two fields of a first one of the rows of the sequence list with an Mth one of the driving signals and a reference signal, and c3) filling, by the driving system, the sequence list using the driving signals.

3. The method of claim 2, wherein sub-step c3) includes, for an $i^{th}$ one of the driving signals:

selecting a starting row from the rows of the sequence list at which the $i^{th}$ one of the driving signals first appears;

filling the starting row of the sequence list by the $i^{th}$ one of the driving signals and another one of the driving signals, the another one of the driving signals corresponding with a largest bit of the binary string whose number of appearances is not equal to the corresponding number of repetitions;

determining whether the number of appearances associated with the $i^{th}$ one of the driving signals in the sequence list equals to the corresponding number of repetitions; and when the determination is affirmative, selecting a subsequent row from the rows of the sequence list, filling the subsequent row of the sequence list at which the $i^{th}$ one of the driving signals appears again and repeating the determination until the number of appearances associated with the $i^{th}$ one the driving signals in the sequence list is equal to the corresponding number of repetitions.

4. The method of claim 3, wherein the starting row of the sequence list is selected by:

identifying a largest number of successive rows in the sequence list in which none of the rows is filled;

determining a middle one of the rows in the largest number of successive rows; and selecting one of the rows subsequent to the middle one of the rows as the starting row.

5. The method of claim 3, wherein the subsequent row is determined based on a constant difference which indicates a distance measured in a number of rows between a prior row and a subsequent row for the $i^{th}$ one of the driving signals.

6. The method of claim 5, wherein the constant difference for the $i^{th}$ one of the driving signals is obtained by dividing a total occurrence number by the corresponding one of the numbers of repetitions of the $i^{th}$ one of the driving signals, and the total occurrence number is obtained by dividing the number of total repetitions by 2.

7. The method of claim 1, wherein:

for an ith one of the driving signals, the predetermined driving period equals 2(i−1)*t2, where t2 represents a unit driving period; and the unit driving period is calculated using an optimization algorithm.

8. The method of claim 7, wherein the optimization algorithm includes the following steps of:

i) comparing an initial driving period with a maximum available driving period which is associated with an upper bound of the unit driving period supported by the driving system;

ii) when it is determined that the initial driving period is larger than the maximum available driving period, setting the initial driving period as a default value;

iii) incrementing the initial driving period by an incremental period to obtain an adjusted driving period, and calculating a total cycle time based on the adjusted driving period, the total cycle time indicating a length of a time period during which the LED device is to be driven by all the driving signals in the entire sequence list;

iv) comparing the total cycle time with a maximum available cycle time;

v) when it is determined that the total cycle time is not larger than the maximum available cycle time, repeating steps iii) and iv); and vi) when it is determined that the total cycle time is larger than the maximum available cycle time, obtaining the unit driving period by subtracting the adjusted driving period by the incremental period.

9. The method of claim 8, wherein step iii) includes calculating the total cycle time by multiplying a cumulative value with the adjusted driving period, the cumulative value being associated with a sum of products of the numbers of repetitions and coefficients of the average driving periods, respectively.

10. The method of claim 1, the driving system further including a multiplexer, wherein in step d), for each of the rows included in the sequence list:

one of the two entries of the driving signals contained in the row is first transmitted to the LED device;

after a portion of the average driving period associated with the one of the two entries of the driving signals has elapsed, the multiplexer switches to transmitting the other one of the two entries of the driving signals to the LED device; and after the portion of the average driving period has elapsed, the multiplexer switches back to transmitting the one of the two entries of the driving signals to the LED device.

11. A method for driving a light-emitting diode (LED) device, the method to be implemented using a driving system that is coupled to the LED device, the method comprising the steps of:

a) receiving, by the driving system, a number (M) of driving signals, each of the driving signals corresponding to a respective predetermined driving period the LED device is to be activated;

b) constructing, by the driving system, a plurality of driving lists, wherein each of the driving lists includes one of a plurality of sets of numbers of repetitions for output of the driving signals, respectively, and a corresponding one of a plurality of sets of average driving periods for the respective driving signals, the corresponding one of the sets of average driving periods being determined based on the predetermined driving periods and said one of the sets of numbers of repetitions;

c) selecting, by the driving system, one of the driving lists, and constructing a sequence list of the driving signals to be sent to the LED device based on the selected one of the driving lists, wherein the sequence list includes a plurality of rows, each of the rows is numbered and includes two fields for containing respectively two entries of the driving signals therein, and a number of times each of the driving signals appearing in the sequence list equals a corresponding one of the numbers of repetitions;

d) sequentially transmitting, by the driving system, the two entries of the driving signals contained in the rows included in the sequence list to the LED device for driving the LED device in the order of the number of rows, with each appearance of one of the driving signals indicating that the LED device is to be activated for the average driving period corresponding to the one of the driving signals; and e) reducing a refresh cycle of the LED device.

12. The method of claim 11, the driving system further including a database, the method further comprising, after step b), the step of storing the driving lists in the database.

* * * * *